US005509387A

United States Patent [19]

Kaminski et al.

[11] Patent Number: 5,509,387

[45] Date of Patent: Apr. 23, 1996

[54] BEARING CAP FOR AN INTERNAL COMBUSTION ENGINE

[75] Inventors: Brian D. Kaminski, Lake Orion; Paul J. Gelazin, Waterford, both of Mich.; William L. Miller, Norwich, England; Roger G. Van Vechten, St. Clair Shores, Mich.

[73] Assignee: General Motors Corporation, Detroit, Mich.

[21] Appl. No.: 395,502

[22] Filed: Feb. 27, 1995

Related U.S. Application Data

[63] Continuation-in-part of Ser. No. 227,753, Apr. 14, 1994, abandoned.

[51] Int. Cl.[6] ..... F02F 7/00

[52] U.S. Cl. ..... 123/195 R; 123/195 H; 384/432

[58] Field of Search ..... 123/195 H, 195 R; 384/429, 432

[56] References Cited

U.S. PATENT DOCUMENTS

| | | | |
|---|---|---|---|
| 1,906,781 | 5/1933 | Wintzer | 123/195 H |
| 2,381,745 | 8/1945 | Herreshoff et al. | 384/432 |
| 4,474,148 | 10/1984 | Kikuchi | 123/195 H |
| 5,024,189 | 6/1991 | Ushio et al. | 123/195 H |

*Primary Examiner*—Noah P. Kamen
*Attorney, Agent, or Firm*—Karl F. Barr, Jr.

[57] ABSTRACT

A main bearing cap for an internal combustion engine has a longitudinally extending body defined in pan by parallel sides which terminate in first and second end portions. The bearing cap has a centrally located, semi-cylindrical bearing recess which cooperates with a corresponding recess in the engine crankcase to support journals of a crankshaft along a crankcase axis. The first and second end portions of the bearing cap include laterally outwardly extending flanged feet having end faces which mate with corresponding surfaces on the engine crankcase. The flanged feet operate against the engine crankcase to limit motion of the bearing cap body.

5 Claims, 2 Drawing Sheets

BEARING CAP FOR AN INTERNAL COMBUSTION ENGINE

This is a c-i-p of application Ser. No. 08/227,753, filed Apr. 14, 1994, abandoned.

TECHNICAL FIELD

The invention relates to internal combustion engine crankcase structures.

BACKGROUND

Internal combustion engines of the reciprocating piston type may have crankcase structures which permit a limited degree of sidewall movement, or torsional distortion, under the operational stresses imposed by the motion of the pistons and crankshaft. Such crankcase sidewall movement may produce undesirable vibration and radiated sound in certain automotive applications.

Cross bolting of the engine main bearing caps to the sidewalls of the crankcase has been shown to reduce such distortion and vibration. U.S. Pat. No. 5,218,938 issued Jun. 15, 1993, in the name of Miller et al., discloses such a bearing cap utilized to increase the rigidity of the base engine structure by integrating a structural oil pan assembly with the engine block.

Bearing caps typically suffer from a structural limitation brought about by typical crankcase design limitations and as a result of the method commonly employed in their manufacture which require that the caps have bodies with substantially parallel side surfaces extending the length thereof. The resultant straight sided bearing cap structure is prone to torsional movement and vibration.

SUMMARY OF THE INVENTION

The present invention relates to a main bearing cap configuration for use in an internal combustion engine having a novel configuration which operates to reduce torsional movement of the cap and engine crankcase structure. The main bearing cap of the present invention includes a longitudinally extending bearing cap body. The body includes substantially parallel sides extending the length of the body and upper and lower sides. The lower side of the bearing cap body includes surfaces for mating with complementary surfaces formed in the engine crankcase. In addition, a semi-cylindrical bearing recess is formed in the bearing cap body and is adapted to cooperate with a corresponding recess in the crankcase structure to retain a respective crankshaft journal for rotation therein.

The longitudinally extending bearing cap body terminates, at rest and second ends, in laterally outwardly extending end portions. The end portions terminate in vertical contact faces which cooperate with complementary faces of the crankcase assembly which, when secured against the crankcase walls, operate to restrain torsional movement of the bearing cap and crankcase structure.

The laterally outwardly extending end portions allow the contact faces of the end portions to have a surface area which is larger than the surface area of a typical bearing cap having an end defined by the termination of parallel sides. As a result, the bearing cap has a greater capability to resist longitudinal bending stress.

Additionally, the laterally outwardly extending end portions of the bearing cap body define a bearing cap width which varies longitudinally along the length of the cap. Such longitudinal variation in cap width provides increased resistance to torsional stresses within the cap resulting in a high level of structural rigidity.

These and other features, objects and advantages of the invention will be more apparent by reference to the following detailed description and to the drawings.

DESCRIPTION OF THE PREFERRED EMBODIMENT

Figure 1:
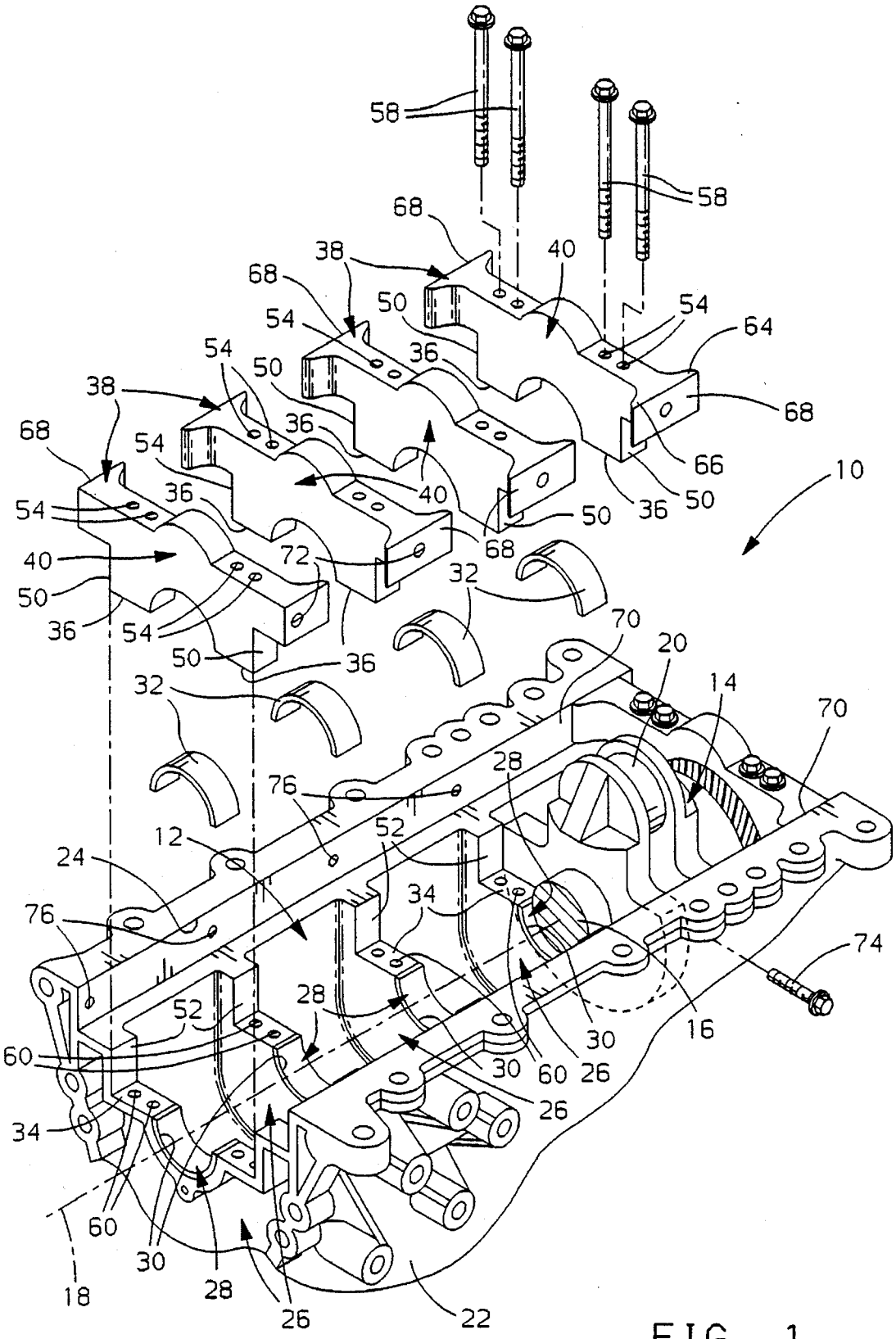
FIG. 1 is a partial, perspective view of the lower portion of an engine crankcase structure embodying the main bearing cap of the present invention, with certain features of the crankcase assembly shown in expanded format.

In FIG. 1, there is shown an engine crankcase structure, designated generally as 10, of an internal combustion engine the lower portion of which defines a crankcase cavity 12 in which is rotatably carried a crankshaft 14. The crankshaft 14 includes a plurality of main journals 16, defining a crankshaft axis 18, longitudinally spaced along its length, between which are located eccentric throws 20, carrying the lower ends of connecting rods (not shown).

The lower portion of the crankcase 10 includes two longitudinally spaced sidewalls 22, 24 which partially define the crankcase cavity 12. Extending transversely across the crankcase cavity 12 and in lateral alignment with each crankshaft journal 16 is a web or bulkhead 26 which connects with opposite sidewalls 22, 24 and which are integrally formed therewith. Centrally located along each web 26 is a semi-cylindrical bearing recess 28 which is adapted to receive one of a pair of main bearing shells 30, 32 and in which the respective crankshaft journal 16 is retained along the crankshaft axis 18.

Figure 2:
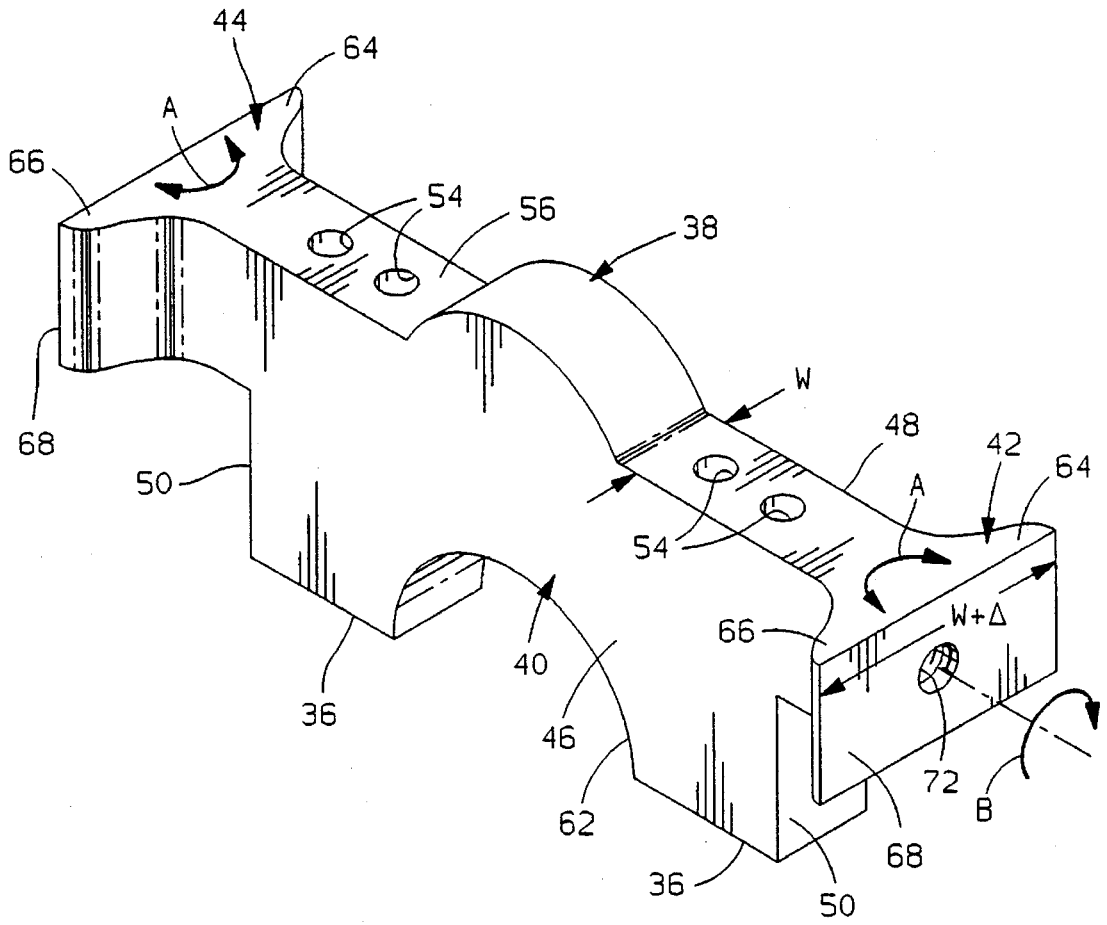
FIG. 2 is a perspective view of a main bearing cap embodying features of the present invention.

Adjacent each side of bearing recess 28 of webs 26, is a horizontal machined face 34 against which lower mating surfaces 36 of one of a plurality of main bearing caps 38, FIG. 2, are retained. Each main bearing cap 38 comprises a longitudinally extending body 40 having first and second end portions 42 and 44 which are interconnected by substantially parallel sides 46 and 48.

The bearing cap 38 may additionally be provided with vertical shoulders 50 which fit closely between complementary vertical shoulders 52 formed in the web 26 of crankcase 10, and which may serve to transversely position the bearing cap 38 with respect to crankcase 10 and, more particularly, crankshaft axis 18.

Bolt holes 54 extend between an upper surface 56 and lower mating surfaces 36 of the cap 38 and are adapted to receive bolts 58 or other suitable securing means such as studs which are threaded into complementary tapped holes 60 in the machined face 34 of web 26. Centrally located along the lower side of the main bearing cap 38 is a semi-cylindrical main bearing recess 62 which is adapted to receive the second of a pair of main bearing shells 32 in which the respective crankshaft journal 16 is retained along crankshaft axis 18 when the bearing cap is installed within the crankcase structure 10.

The first and second outer end portions 42 and 44 of the bearing cap body 40 are configured so as to extend laterally outwardly with respect to the parallel sides 46 and 48. Specifically, the end portions comprise flanged or filleted feet 64 and 66 which extend laterally outwardly from the parallel sides 46 and 48 of the cap body 40 and which terminate in vertical faces 68 which are configured to mate with complementary vertical faces 70 along the sidewalls 22 and 24 of the engine crankcase. The vertical end faces 68 preferably include tapped holes 72 which receive securing bolts or studs 74 which extend through corresponding openings 76 in the engine crankcase sidewalls thereby securing the end portions 42, 44 of the bearing caps 38 to the engine crankcase sidewalls 22, 24.

With the bearing caps 38 installed in the engine crankcase as described, the laterally outwardly extending flanged portions 64 and 66, which define the vertical end faces 68 of the bearing cap 38, operate in concert with the vertical faces 70, against the sidewalls 22, 24 of the engine crankcase 10 to resist lateral twisting motion, indicated at "A" in FIG. 2. The resultant reduction in such motion reduces vibration and radiated noise.

Additionally, the laterally outwardly extending flanged end portions 64, 66 of the bearing cap 38 define a bearing cap width which varies longitudinally along the length of the bearing cap. For instance, the width of the bearing cap 38 at a location closely adjacent the crankshaft centerline 18 is "W", a dimension closely dictated by the crankshaft dimensions. At the ends 42 and 44, the width of the bearing cap due to the laterally outwardly extending flanged portions 64, 66 increases to "W+Δ". As a result of the varying width of the cap body 40 in the lateral direction, the bearing cap structure is highly resistant to torsional movement about the longitudinal axis of the bearing cap 38, as indicated at "B".

Construction of the bearing cap disclosed herein, may depart from the typical methods used to manufacture standard bearing caps. In general, bearing caps are constructed in a single casting which is subsequently cut and machined into several finished bearing cap members. The present bearing cap structure is particularly well suited to manufacture by powder metal forming processes. The powder metal forming method lends itself to the formation of complex structural castings without the requirement of extensive post-forming machining.

We claim:

1. A main bearing cap for an internal combustion engine comprising a longitudinally extending body having parallel planar sides terminating in first and second end portions, said first and second end portions comprising flanged feet extending laterally outward from said sides and having end faces configured to mate with complementary faces of said internal combustion engine and operable to resist lateral twisting motion of said body.

2. A main bearing cap for an internal combustion engine comprising a longitudinally extending body having parallels planar sides terminating in first and second end portions a centrally located semi-cylindrical main bearing recess located along a lower side, adapted to receive a crankshaft bearing journal therein, mating surfaces located adjacent said main bearing recess and configured to engage corresponding surfaces in said engine, through holes extending between an upper surface of said body and said mating surfaces which are configured to receive mounting hardware for securing said bearing cap to said engine in a first direction, said first and second end portions comprising flanged feet extending laterally outward from said sides and having end faces configured to mate with complementary faces of said internal combustion engine and operable against said complementary faces of said internal combustion engine to resist motion of said longitudinally extending body.

3. A main bearing cap for an internal combustion engine as defined in claim 2, said end faces of said laterally outwardly extending flanged feet including tapped holes configured to receive mounting hardware for securing said bearing cap to said engine in a second direction.

4. An internal combustion engine including a crankcase structure for rotatably supporting a crankshaft therein, said crankshaft having a plurality of main journals, defining a crankshaft axis, longitudinally spaced along its length, said crankcase structure comprising first and second longitudinally spaced sidewalls and a plurality of transversely extending webs, longitudinally aligned with said crankshaft journals, extending between said sidewalls and integral therewith, said webs including semi-cylindrical bearing recesses adapted to each receive one of said crankshaft journals, and one of a plurality of main bearing caps, each cap comprising a longitudinally extending body having parallel planar sides terminating in first and second end portions, a centrally located, semi-cylindrical main bearing recess located along a lower side, adapted to receive one of said crankshaft journals therein and mating surfaces located adjacent said main bearing recess and configured to engage corresponding surfaces located on a respective transversely extending web, said bearing caps further comprising through holes extending between an upper surface of said body and said lower mating surfaces which are configured to receive mounting hardware for securing said bearing cap to said transverse web in a first direction, and said first and second end portions comprising flanged feet extending laterally outward from said sides and having end faces configured to mate with complementary faces of said first and second longitudinally spaced sidewalls of said crankcase said laterally extending feet operable against said sidewalls to resist motion of said longitudinally extending bearing cap body.

5. An internal combustion engine, as defined in claim 4, said end faces of said laterally outwardly extending flanged feet of said main bearing caps including tapped holes configured to receive mounting hardware for securing said bearing caps to said engine in a second direction.

* * * * *